US012036464B2

(12) United States Patent
Arnold et al.

(10) Patent No.: US 12,036,464 B2
(45) Date of Patent: Jul. 16, 2024

(54) PUTTING TRAINING DEVICE

(71) Applicant: Arnolds Innovations Pty Ltd, Dolans Bay (AU)

(72) Inventors: Brett Arnold, Dolans Bay (AU); Craig Andrews, Kirribilli (AU); Rohaan Taneja, Kirribilli (AU)

(73) Assignee: Arnolds Innovations Pty Ltd, Dolans Bay (AU)

( * ) Notice: Subject to any disclaimer, the term of this patent is extended or adjusted under 35 U.S.C. 154(b) by 295 days.

(21) Appl. No.: 17/287,916

(22) PCT Filed: Oct. 22, 2019

(86) PCT No.: PCT/AU2019/051154
§ 371 (c)(1),
(2) Date: Apr. 22, 2021

(87) PCT Pub. No.: WO2020/082121
PCT Pub. Date: Apr. 30, 2020

(65) Prior Publication Data

US 2021/0379466 A1 Dec. 9, 2021

(30) Foreign Application Priority Data

Oct. 22, 2018 (AU) ..... 2018904008
Dec. 17, 2018 (AU) ..... 2018904784

(51) Int. Cl.
*A63B 69/36* (2006.01)
*A63B 53/00* (2015.01)
(Continued)

(52) U.S. Cl.
CPC ..... *A63B 69/3685* (2013.01); *A63B 60/46* (2015.10); *A63B 69/36* (2013.01);
(Continued)

(58) Field of Classification Search
CPC ..... A63B 69/3685; A63B 60/46; A63B 69/36
See application file for complete search history.

(56) References Cited

U.S. PATENT DOCUMENTS 4,174,838 A * 11/1979 Paschetto ..... A63B 69/3685 473/238
4,674,324 A * 6/1987 Benoit ..... G01M 1/10 73/65.03
(Continued)

FOREIGN PATENT DOCUMENTS

JP 6015363 B2 4/1985
JP 3105267 B2 10/2000
(Continued)

OTHER PUBLICATIONS

International Search Report issued for PCT/AU2019/051154 dated Jan. 24, 2020.
(Continued)

*Primary Examiner* — Eugene L Kim
*Assistant Examiner* — Christopher Glenn
(74) *Attorney, Agent, or Firm* — Braxton Perrone, PLLC; Bobby W. Braxton; Gregory Perrone

(57) ABSTRACT

A putting training device attachment including a shaft mount for mounting on a putter shaft; a pendulum assembly mounted on the mount; an indicating gauge connected to the pendulum assembly for indicating a preferred track for the pendulum. A putter is described for training.

19 Claims, 11 Drawing Sheets

(51) Int. Cl.
*A63B 60/46* (2015.01)
*A63B 71/06* (2006.01)

(52) U.S. Cl.
CPC ..... *A63B 71/06* (2013.01); *A63B 53/007* (2013.01); *A63B 2071/0602* (2013.01); *A63B 2071/0625* (2013.01); *A63B 2209/08* (2013.01); *A63B 2210/50* (2013.01); *A63B 2220/16* (2013.01); *A63B 2225/09* (2013.01)

(56) References Cited

U.S. PATENT DOCUMENTS 5,169,151 A * 12/1992 Conley ..... G01P 15/0888 473/220
5,836,829 A * 11/1998 Van Cott ..... A63B 69/3632 473/224
2006/0084517 A1* 4/2006 Sherman ..... A63B 69/3685 473/221
2009/0143158 A1* 6/2009 Fidge ..... A63B 69/3614 473/238
2012/0302380 A1* 11/2012 Erkkinen ..... A63B 69/3638 473/437
2013/0040750 A1 2/2013 Simizu

FOREIGN PATENT DOCUMENTS

JP 2006501971 A 1/2006
KR 20040106888 A 12/2004
KR 20120013510 A 2/2012
WO 2004030771 A1 4/2004
WO 2011019024 A1 2/2011

OTHER PUBLICATIONS

Office Action Translation of Patent Application No. JP 2021-523015 dated Sep. 26, 2023.

* cited by examiner

PUTTING TRAINING DEVICE

PRIORITY CLAIM

This application is a US 371 Application from PCT/AU2019/051154 filed Oct. 22, 2019, which claims priority from AU2018904784 filed Dec. 17, 2018 and AU2018904008 filed Oct. 22, 2018, the entire contents of which are incorporated herein by referring to them in this statement.

TECHNICAL FIELD

The present technology relates generally to the sport of golf, and in particular, to putting training devices.

BACKGROUND

Club sports can be challenging at which to succeed.

Golf, in particular, is very difficult to master. Optimally and accurately swinging a golf club can be very difficult, because so many variables come into play. It is said that there are more than 90 variables in a stroke, including ball position, grip, hand position, stance, hand-to-lower-arm angle, spine angle, club length.

One important swing variable in putting is face rotation.

Another variable in putting is swing plane, and whether the putter head stays within a plane, and whether, and if so, at what part of the stroke, the putter leaves the plane.

There are devices known, which attach to putter shafts, but those devices are overly complex, heavy, and change the feel of the putt.

The present inventor seeks to provide a new device which facilitates improvements to putting, which substantially ameliorates at least one of the abovementioned disadvantages, and/or which at least provides a useful alternative to known devices.

SUMMARY

Broadly, the present technology provides a putting training device.

Broadly, the present technology provides a putting training attachment which indicates to a user when a putter is swung out of plane.

Broadly, the present technology provides a putting training device and/or an attachment and/or a putter which indicates that user is imparting incorrect face rotation during a putt.

Broadly, the present technology provides a putting indicator attachment which indicates to a user when a putt swing is out of plane and/or rotated.

The arrangement is such that when embodiments are in use the user can identify whether, and by how much, their putt swing is out of plane when using the device or attachment or club. The user may be able to identify how to improve the swing by the information presented on the indicator.

In accordance with one aspect of the present invention there is provided a putting training device including:

- a shaft mount for mounting on a putter shaft;
- a pendulum assembly mounted on the shaft mount;
- an indicating gauge connected to the pendulum assembly for indicating a preferred track for the pendulum.

In accordance with another aspect of the present invention there is provided a putter which includes:

- a putter shaft;

- an integral or affixed pendulum assembly mounted on the putter shaft at a distal region thereof;
- an indicating gauge connected to the pendulum assembly for indicating a preferred track for the pendulum.

In accordance with another aspect of the present invention there is provided a putting trainer which includes:

- a putter shaft without a head;
- an integral or affixed pendulum assembly mounted on the putter shaft at a distal region thereof;
- an indicating gauge connected to the pendulum assembly for indicating a preferred track for the pendulum.

The arrangement may be such that in embodiments the putter or trainer is gently swung so that it aligns with the indicating gauge during a putt or a practise putt.

Shaft Mount

In one embodiment the shaft mount is a clip.

In one embodiment the clip includes opposed resilient arms for receiving a portion of a putter shaft section.

In one embodiment the clip includes one or more pivoting arms.

In one embodiment the clip includes a biasing element to bias the arms to a closed position.

In one embodiment the shaft mount includes one or more magnets to hold the mount to the club shaft.

In one embodiment the biasing element includes one or more magnets.

In one embodiment the one or more biasing elements are disposed at the ends of the arms so as to keep the arms in contact with the club shaft.

In one embodiment the clip includes lead-ins to guide the shaft into the clip, for ease of attachment on the shaft.

In one embodiment the clip includes a grip liner covering internal clip walls to increase friction on the putter shaft.

In one embodiment the grip liner includes a resilient material such as for example, rubber, silicone, or plastic.

In one embodiment the clip includes a grip on opposed faces to maintain a grip on the putter shaft.

In one embodiment the grip includes a plurality of grip ribs spaced around or along the clip faces.

In one embodiment the grip ribs extend, when in the deployed position on the shaft, parallel to the longitudinal axis of the shaft.

In one embodiment the mount includes a movable joint to orient the pendulum in an upright position.

In one embodiment the joint includes a hinge to provide at least one axis of freedom in adjustment.

In one embodiment the joint includes a ball joint to provide at least one axis of freedom in adjustment.

In one embodiment the joint includes a universal joint.

Pendulum Assembly

First, it is to be understood that the word pendulum may encompass not only swinging pendula, of a classic form, where a ball on a string swings back and forth, but also a rigid bar, with or without a mass on its end, swings, and also a more linear horizontal movement, such as a spring with a mass, the latter of which can slide along a surface with a predetermined period (frequency) and amplitude, the direction of which still can still be altered by some angle, depending on the swing of a putter to which it is ultimately attached.

It is also to be understood that although most pendulums swing from a top anchor, some embodiments of pendulum which are part of the technology may be anchored at a base, such that a swaying motion is imparted during a putt. The arrangement of the sway pendulum is such that the pendulum is a pipe, tube, reed, or bar, mounted on, say, a torsion spring, or windsurfer knuckle, or rubberised universal joint.

Additionally the pendulum may be in the form of an enlarged head which may facilitate a slow swaying motion. It is to be understood that this standing or upside-down arrangement is fully within the scope of the invention.

In one embodiment (the hanging embodiment) the pendulum assembly includes a frame to support a swinging pendulum. In the standing embodiment the pendulum assembly does not require a frame from which to hang a pendulum.

Working Gauge

In one embodiment the frame defines a working gauge within which the pendulum is configured to swing. Essentially it is to be understood that the working gauge is like a railway gauge, wherein a frame is configured to set the limits of lateral variance of the pendulum. The lateral limits are set because when the training device is set up correctly on the putter shaft, and in use, the pendulum will hit some portion of the working gauge if the putter is swung laterally too far, or swing out of alignment with the face.

In one embodiment the working gauge is defined by a peripheral frame assembly. There may be provided one or more gaps in the peripheral frame, and still the working gauge will be defined, since all that is required for the frame to function as a working gauge would be two spaced-apart frame elements adjacent the pendulum itself (whether in a hanging or standing arrangement). This is because the base (being the ball, or weight) of a pendulum is the element of the pendulum that will travel the farthest from a midline.

In the standing embodiment the working gauge may be two spaced-apart posts.

The working gauge provides a physical barrier which is configured to make a noise when hit by the pendulum so as to indicate to the user that the swing was deficient in one way or another.

In one embodiment the peripheral frame assembly includes a pendulum mount at a top of the frame assembly. In one embodiment the pendulum mount is a mount for a string, or a rigid element. In one embodiment the string mount may be a notch or boss or other locating element. In one embodiment the pendulum mount may be a ball and socket joint. In one embodiment the pendulum mount may be a hook and chain, or the like, to allow free swinging of a bar.

In one embodiment, a pendulum is provided, connected to a top of the frame assembly so that it can swing through the gauge.

In one embodiment the pendulum is a mass disposed on a distal end of a line, to provide free swinging. In one embodiment the mass may be a ball or a cube, or another suitable kind of mass which facilitates its swinging through the working gauge.

In one embodiment, the pendulum may be a rigid element such as for example a steel bar, plastic bar, or metal bar. In one embodiment the rigid element may swing on a hinge, ball joint, or other (at least) two-axis pivoting mount. The rigid element may be thinner at a top region and thicker at a base region to facilitate swinging. There may be more mass at a base region of the rigid element than at the top region.

In one embodiment the working gauge is a frame element which extends generally from the putter shaft mount at its base end, to generally the pendulum mount at the top end, together with another frame element disposed near the base end, and spaced from the shaft mount, extending upward to provide at least a post or barrier or wall which is configured to serve as a lateral boundary for the pendulum.

One or more of the working gauge frame elements may take any particular path, mirroring the shape of the pendulum, for example. The working gauge frame elements may be vertical, or follow a scalloped path, or may be angled to the vertical, or take any suitable path to provide a lateral barrier for any particular part of the pendulum. The elements may selectively extend inwards, or there may be bosses or other formations which may be attached, or swung, or otherwise put into place to extend inward across the working gauge to increase the difficulty of the swing. That is, the closer the frame elements to a centreline of the pendulum swing track, or to each other, then the more difficult the swing.

In one embodiment there are provided one or more frame elements which include extensible elements which are extensible toward a midline of the pendulum swing, or to each other. In one embodiment one extensible element may be a plate that extends upwards, or sidewards, to narrow or shorten the working gauge. In one embodiment the plate is a v-shape, such that if it extends from the base, it will reduce the working gauge. In one embodiment the plate is a rectangle, and may extend in from one side element towards the centreline. Two plates may be deployed, and may be linked to one another In one embodiment there is provided a swing attenuator to reduce the difficulty of the swing. With the swing attenuator deployed, the pendulum will not swing as far as with the swing attenuator in a stowed position.

In one embodiment the swing attenuator includes a bar which extends across the working gauge to reduce the amplitude of the swinging pendulum. There may be one or more bars which may be swung into a deployed position across the path of the pendulum. This will have the effect of reducing the period, increasing the frequency of the swing, but also reducing the amplitude.

There may be provided a winder for the pendulum line so as to shorten or lengthen the line.

In one embodiment the swing attenuator is a grub screw or other tightening apparatus which increases the friction on the movement of the ball and socket joint.

In one embodiment there is provided a sliding plate which can slide downward from the top of the working gauge to attenuate the swing of the pendulum.

In one embodiment there is provided a swinging plate which can swing across the path of the swinging pendulum to cause the swing's amplitude to be reduced.

In one embodiment the swing attenuator is a sleeve which is configured to adopt a stowed and a deployed position. In the stowed position the sleeve is disposed at a top of the pendulum, adjacent the pendulum mount, and in a deployed position the sleeve is disposed a distance from the top of the pendulum mount.

In one embodiment the sleeve is slidable mounted on the frame assembly.

In one embodiment there is provided a crown, collar, cuff or rings or any kind of suitable structure which is configured to attach to the pendulum or working gauge elements to effectively widen the pendulum or narrow the working gauge to increase the difficulty of the device (when the skill level of the user increases and the putting improves).

In one embodiment the sliding sleeve includes a central guide to keep the pendulum on the centreline.

In one embodiment the swing attenuator is a biasing means which biases the pendulum to the centreline. The biasing means in one embodiment is a spring or rubber mount.

In one embodiment the swing attenuator includes a magnet disposed in a base of the pendulum assembly, under a centre point of the swing. A cooperating ferrous element or magnet is also provided adjacent the magnet, in the pendulum.

Indicating Gauge

The indicating gauge in one embodiment is a gauge surface which indicates a preferred track for the pendulum to follow during a stroke.

In one embodiment the gauge surface is part of one or more gauge plates.

In one embodiment the one or more plates are mounted to one or more frame elements.

In one embodiment the one or more plates are transparent or translucent so that the user may see the putter through the plate. In one embodiment the one or more plates are formed from plastic.

In one embodiment the gauge surface includes an indicating track mounted on or in the plate. In one embodiment the indicating track is an aperture or plurality of apertures through the plate to show the preferred track. In one embodiment the aperture is a linear cut through the plate so the player may more easily aim the pendulum by blocking the light which issues through the cut. The linear cut may be formed from dashes or dots, again, to facilitate guiding the pendulum along the track, and hence, the putter itself. In one embodiment the indicating track is a painted or printed line on the surface of the one or more plates.

In one embodiment the one or more plates are pivotally mounted on the frame.

In one embodiment the one or more plates are configured to adopt a stowed position in which the plate (and track) are disposed in a vertical position, in which the track is not visible by the player during a stroke, and a deployed position in which the track is visible by the player during a stroke.

In one embodiment the training device is configured to adopt a stowed position in which the pendulum is inhibited from swinging, and a deployed position in which the pendulum is free to swing.

In one embodiment the gauge plates are flat frames.

In one embodiment the gauge plates include retainers for the pendulum.

Other Features

The training device may be configured to adopt a stowed position and a deployed position. The arrangement of the technical elements in the stowed position is such that the pendulum is kept from swinging and being tangled up in the frame elements, while in the deployed position the pendulum is free to swing.

A keeper assembly is provided to keep the pendulum in the stowed position. The keeper is in the form of a shield assembly mounted on the frame. The shield assembly may be the gauge plates.

In one embodiment the one or more frames may include an annulus for receiving and retaining the pendulum.

The gauge (keeper) plates may include one or more retaining flanges, so that they are effectively domed so as to retain the pendulum mass inside the borders of the plates, keeping the pendulum tidy.

Advantages

Advantageously, embodiments of the putting trainer provide a user with a guide as to how to swing the putter. Embodiments of the guide indicate to the user whether the plane of swing is offline, whether the head of the putter is offline, and by how much. Embodiments of the putting trainer are unobtrusive and light, can be readily deployed and stowed, attached and detached, and also the swing can be adjusted for the skill of the user.

Clarifications

In this specification, where a document, act or item of knowledge is referred to or discussed, this reference or discussion is not an admission that the document, act or item of knowledge or any combination thereof was at the priority date:

(a) part of common general knowledge; or (b) known to be relevant to an attempt to solve any problem with which this specification is concerned.

It is to be noted that, throughout the description and claims of this specification, the word 'comprise' and variations of the word, such as 'comprising' and 'comprises', is not intended to exclude other variants or additional components, integers or steps.

BRIEF DESCRIPTION OF THE DRAWINGS

In order to enable a clearer understanding, a preferred embodiment of the technology will now be further explained and illustrated by reference to the accompanying drawings, in which.

DETAILED DESCRIPTION OF AN EXAMPLE EMBODIMENT

Figure 1:
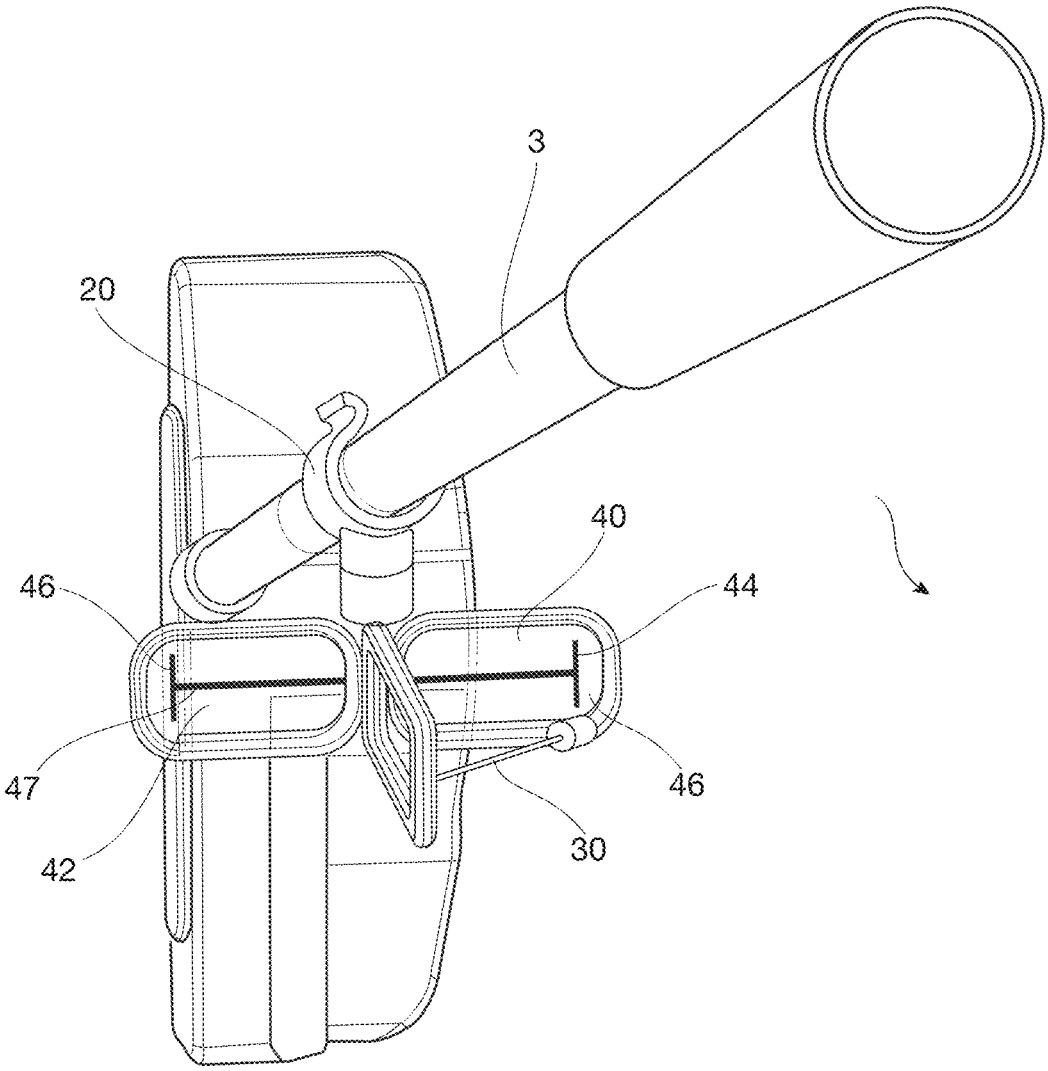
FIG. 1 is a perspective view from above of the training device, such as that which would be seen by a user when the training device is attached and deployed.

Referring to the drawings there is shown a putting training device generally indicated at 10. In the drawings, like numerals denote like parts. (eg 10, 110 for different embodiments of the putting training device).

The putting training device 10 includes a shaft mount 20 for mounting on a putter shaft 3; and a pendulum assembly 30 mounted on the shaft mount 20. There is an indicating gauge 40 connected to the pendulum assembly 30 for indicating a preferred track for the pendulum.

The shaft mount 20 is a clip 22, which includes opposed resilient arms 24 for receiving a portion of the putter shaft 3. The clip 22 can be seen to include lead-ins 25 to guide the shaft 3 into the clip 22. The clip 22 further includes a grip liner 26 covering internal clip walls to increase friction on the putter shaft 3. The clip 22 includes resilient jaws so as to adjust to different diameters of putter shaft. The grip liner 26 may include, as is shown in FIGS. 6 to 11, ribs 126 of an elastomeric material which provides further adjustment to accommodate different shaft diameters, but also increased grip on the shaft.

The shaft mount 20 includes a joint 27 which facilitates a user orienting the pendulum assembly in an upright position when installed on the putter shaft 3. The joint is a pivot.

The pendulum assembly 30 includes a frame 32 to support a swinging pendulum 34. The frame 32 defines a working gauge 35 within which the pendulum 34 is configured to swing. Essentially the working gauge 35 is configured to set the limits of lateral variance to the putter swing because when the training device is set up correctly on the putter shaft, the pendulum will hit some portion of the working gauge if the putter is swung laterally too far, or swing out of alignment with the face.

The working gauge 35 is defined in the embodiment shown by a peripheral frame assembly 36. The peripheral frame assembly 36 includes a pendulum mount 37 at a top 38 of the peripheral frame assembly 36 which allows free swinging of a bar or a string. The pendulum mount 37 is a ball and socket joint 39.

Figure 2:
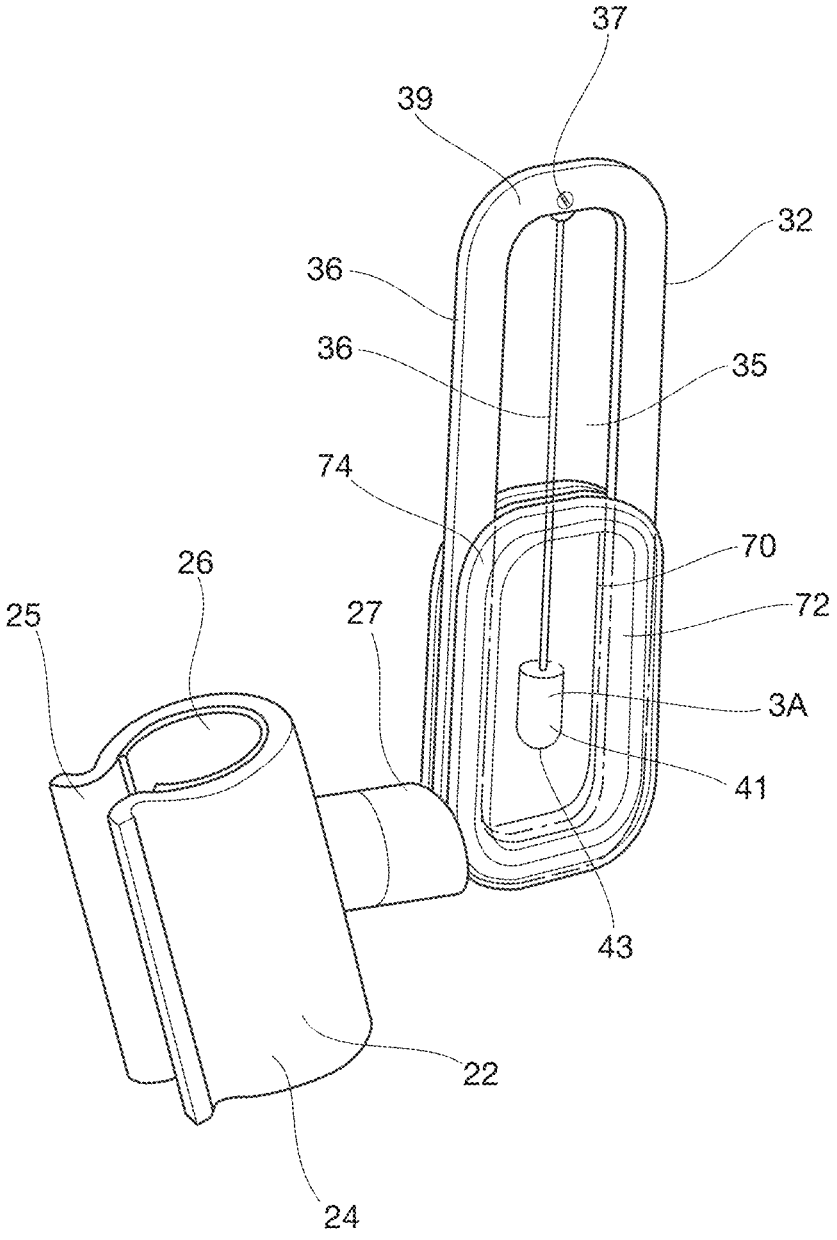
FIG. 2 is a perspective view from in front of the training device, detached from a putter shaft, and in a stowed position.
Figure 3:
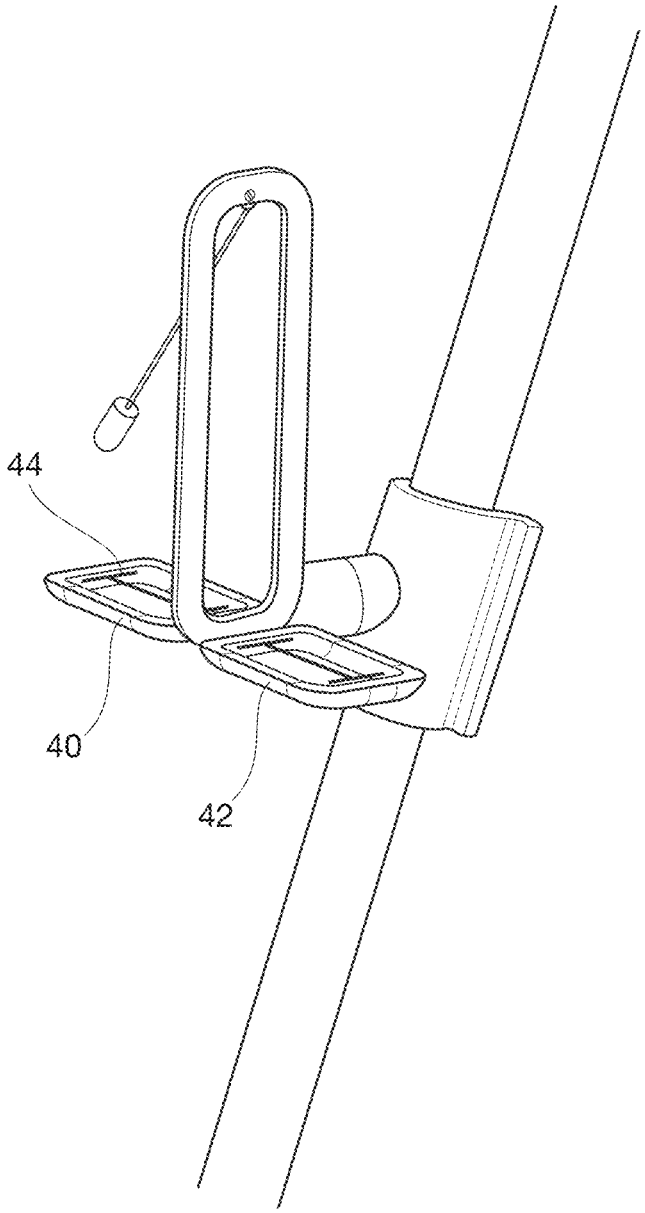
FIG. 3 is a perspective view from one side, showing the training device attached to a putter shaft and in a deployed position, with the pendulum swinging.

The pendulum assembly 30 provides periodic swinging of the pendulum 34, and the freedom to deviate from a line if the putter shaft is swung offline. The pendulum 34 is shown in FIGS. 1 to 3 to be a mass 41 disposed on a distal end of a bar 42 which may be mounted on a ball joint, to provide several periods of periodic swinging for one stroke, without requiring too much energy input. The mass 41 is generally a cylinder 43 and sized so that it does not take up too much room in the working gauge. In the other Figures the mass 41 is a sphere 143, which hangs on a string or a line, tied off to from a knot which is hidden in knot housings 145 and 145A for tidy stowage.

Figure 4:
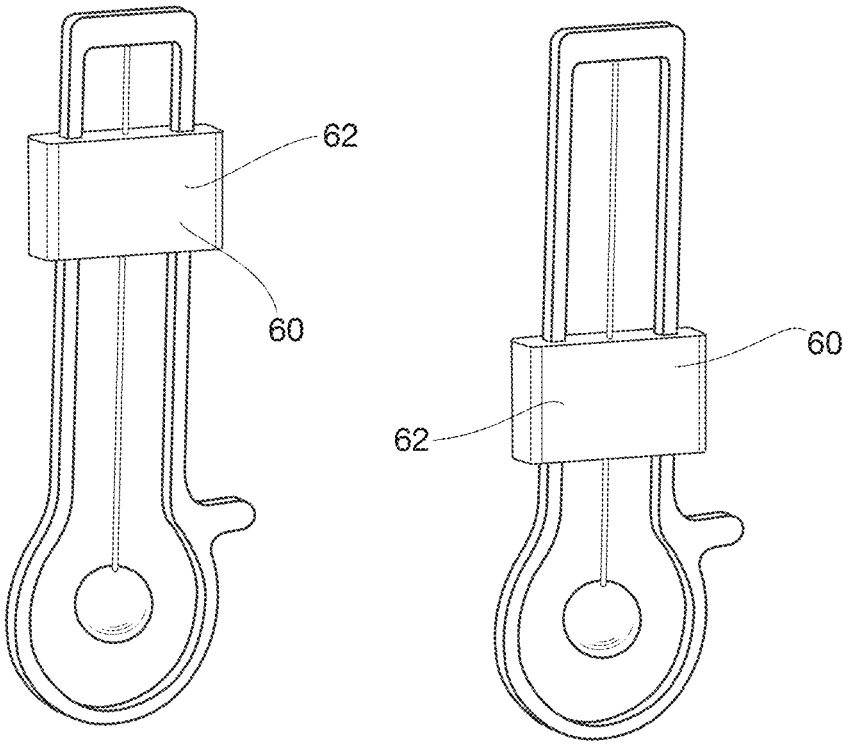
FIG. 4 shows another embodiment of training device, with particular emphasis on a swing attenuator, on the left, shown in a stowed position, and on the right, shown in an attenuation or deployed position.
Figure 5:
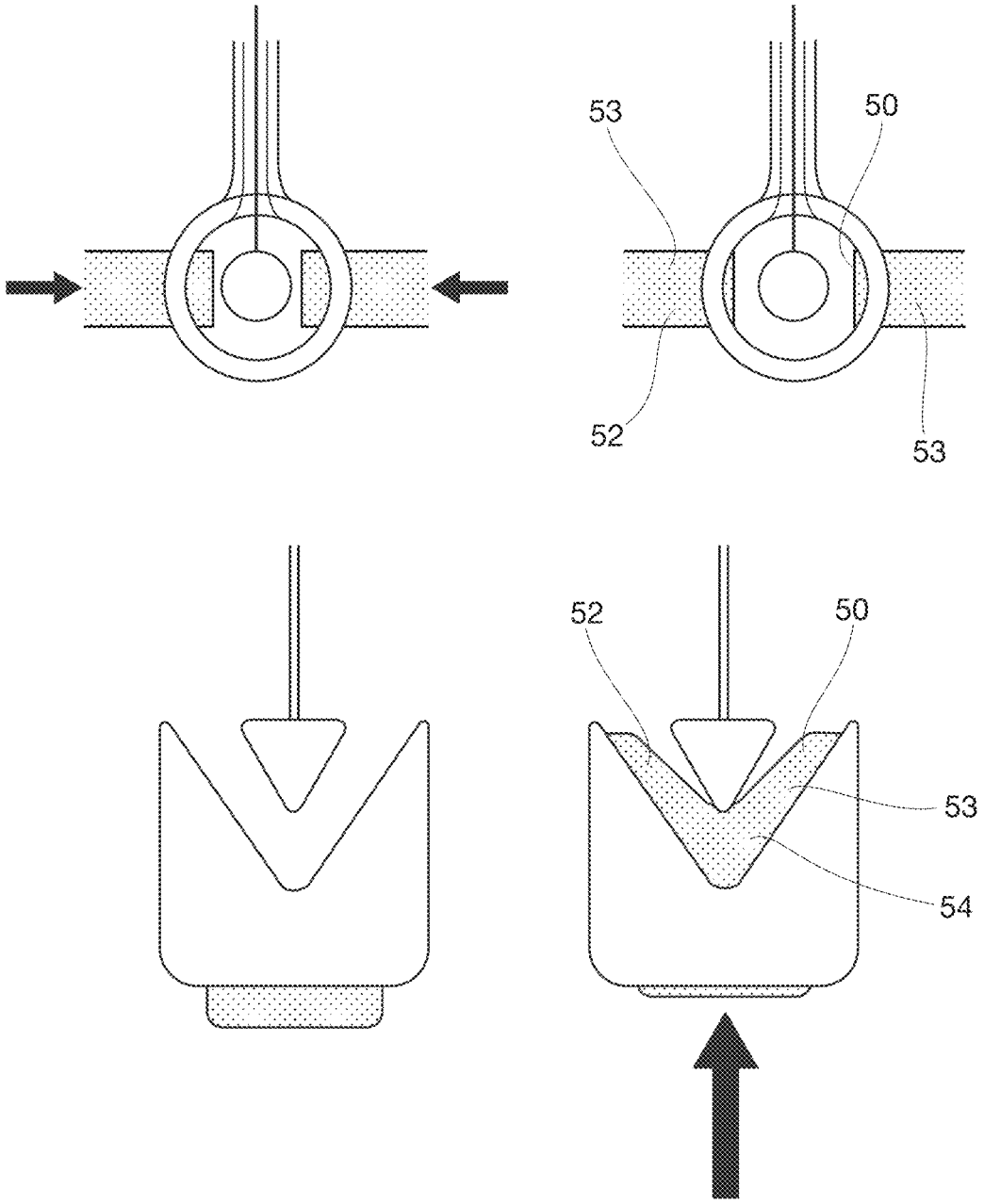
FIG. 5 shows embodiments of difficulty adjusters, in which the frame elements extend into the path of the pendulum.
Figure 6:
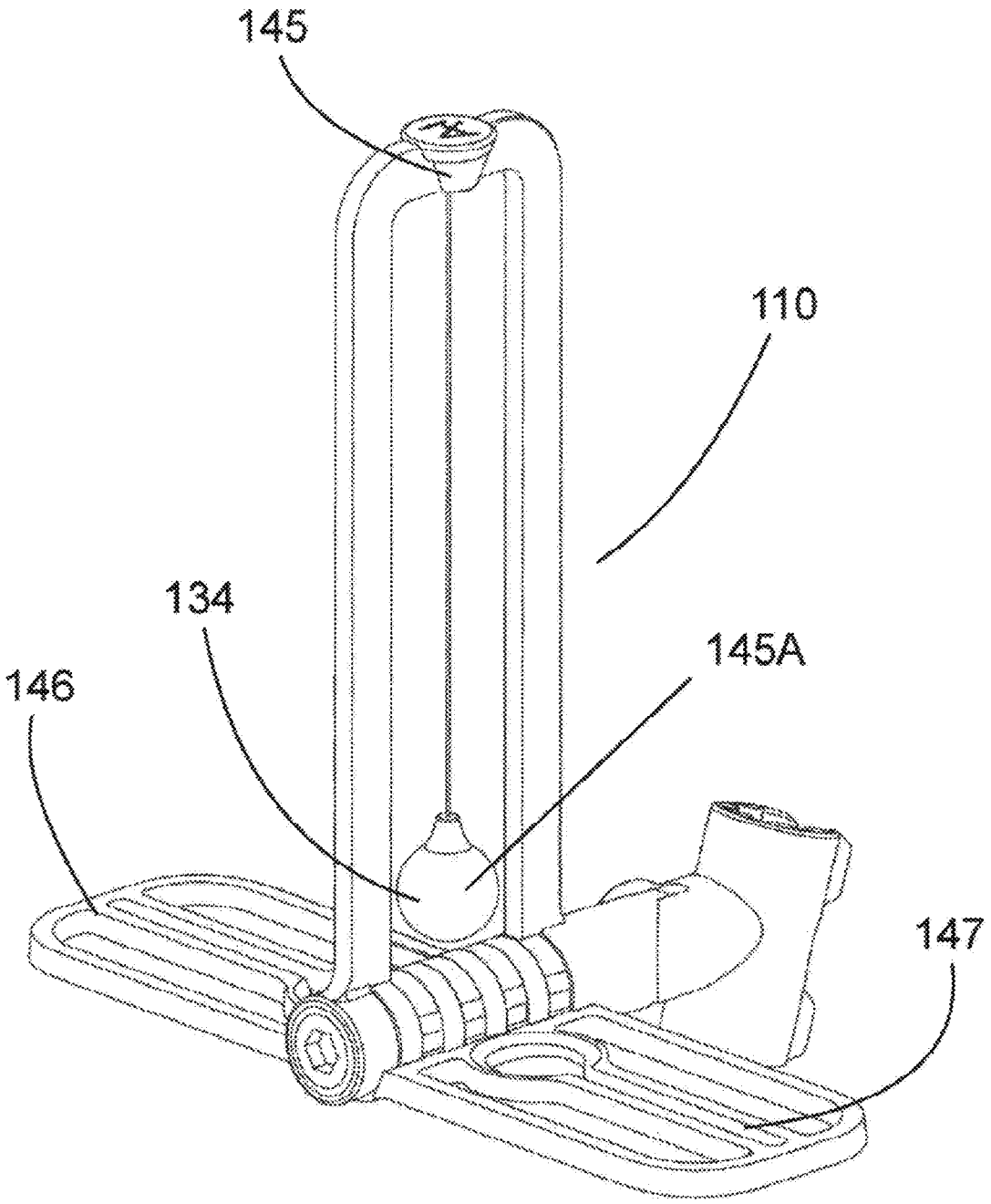
FIG. 6 is an isometric view of another embodiment of a training device with an indicator assembly in a deployed position.
Figure 7:
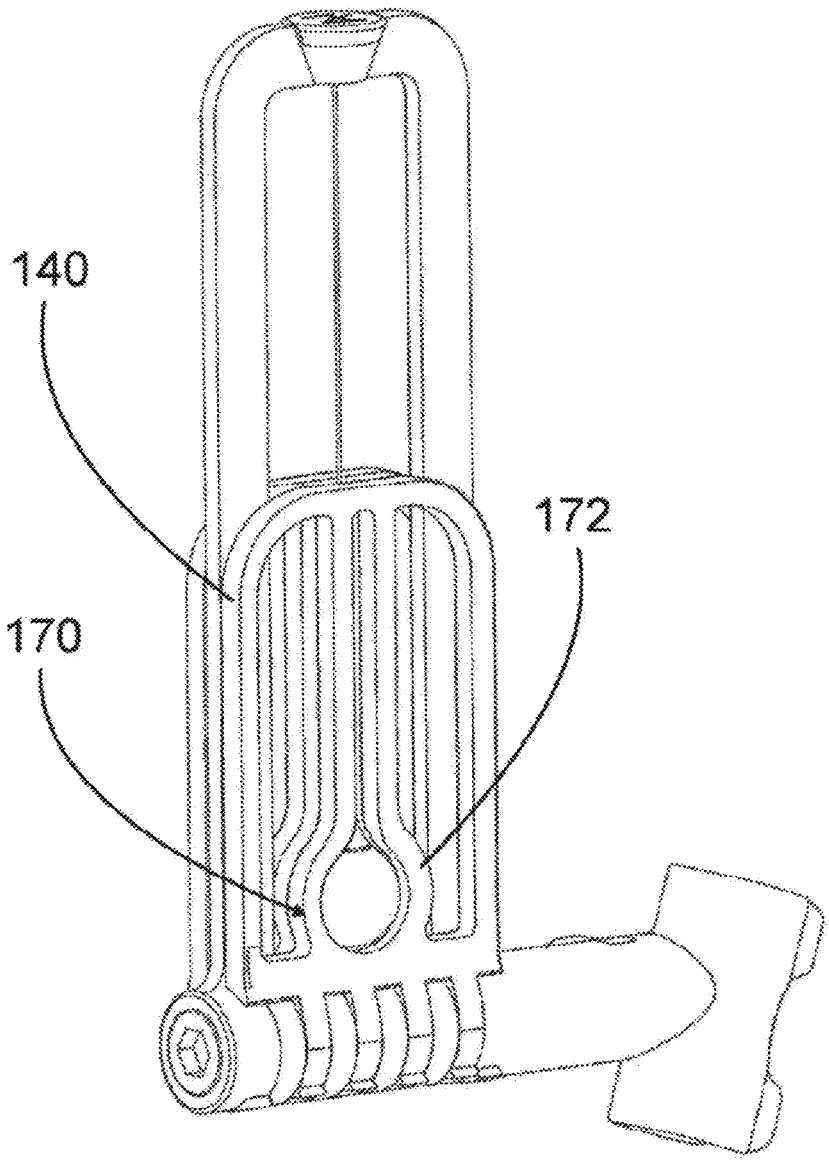
FIG. 7 is an isometric view of the embodiment shown in FIG. 6 with the indicator assembly in a stowed position.
Figure 8:
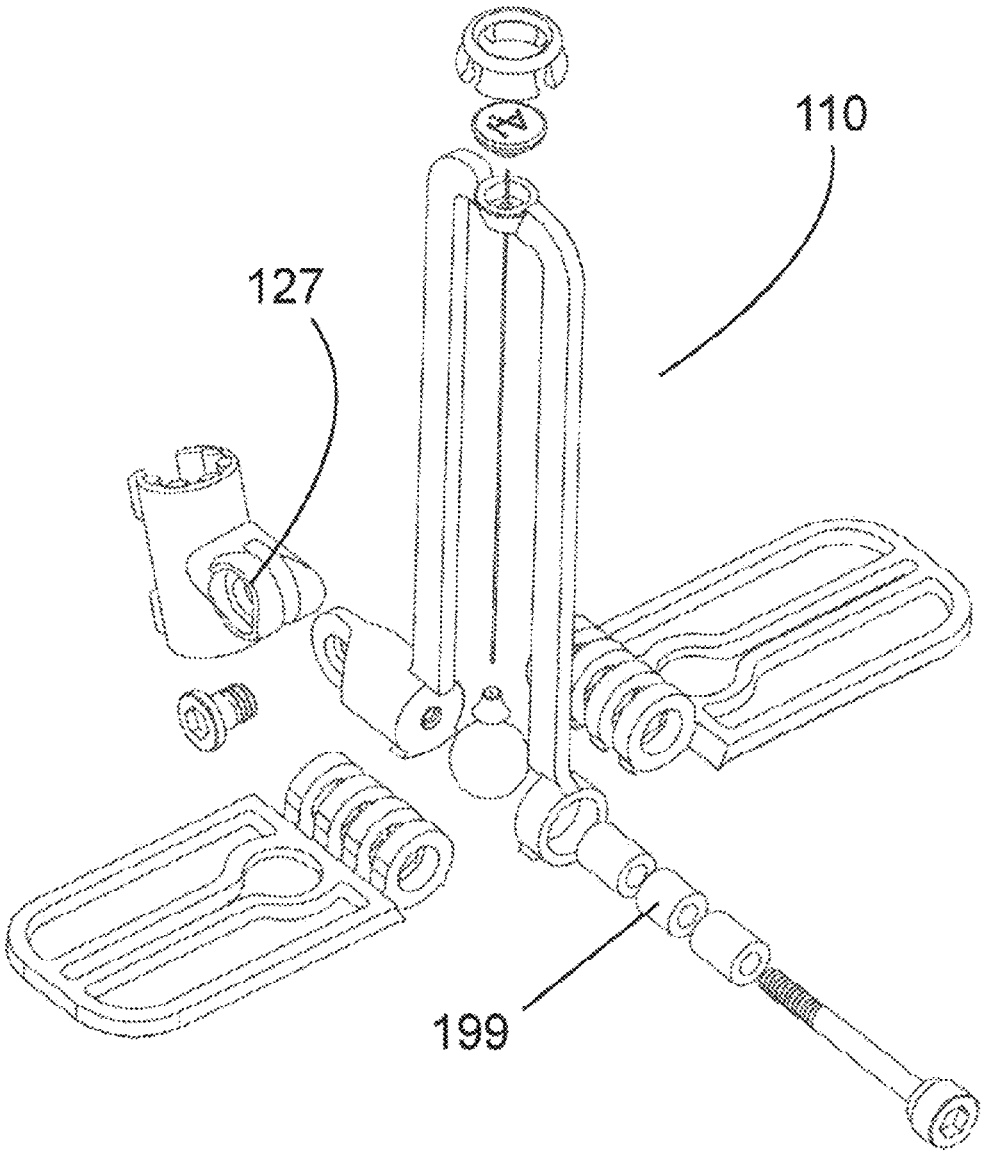
FIG. 8 is an exploded view of the embodiment shown in FIG. 6.
Figure 9:
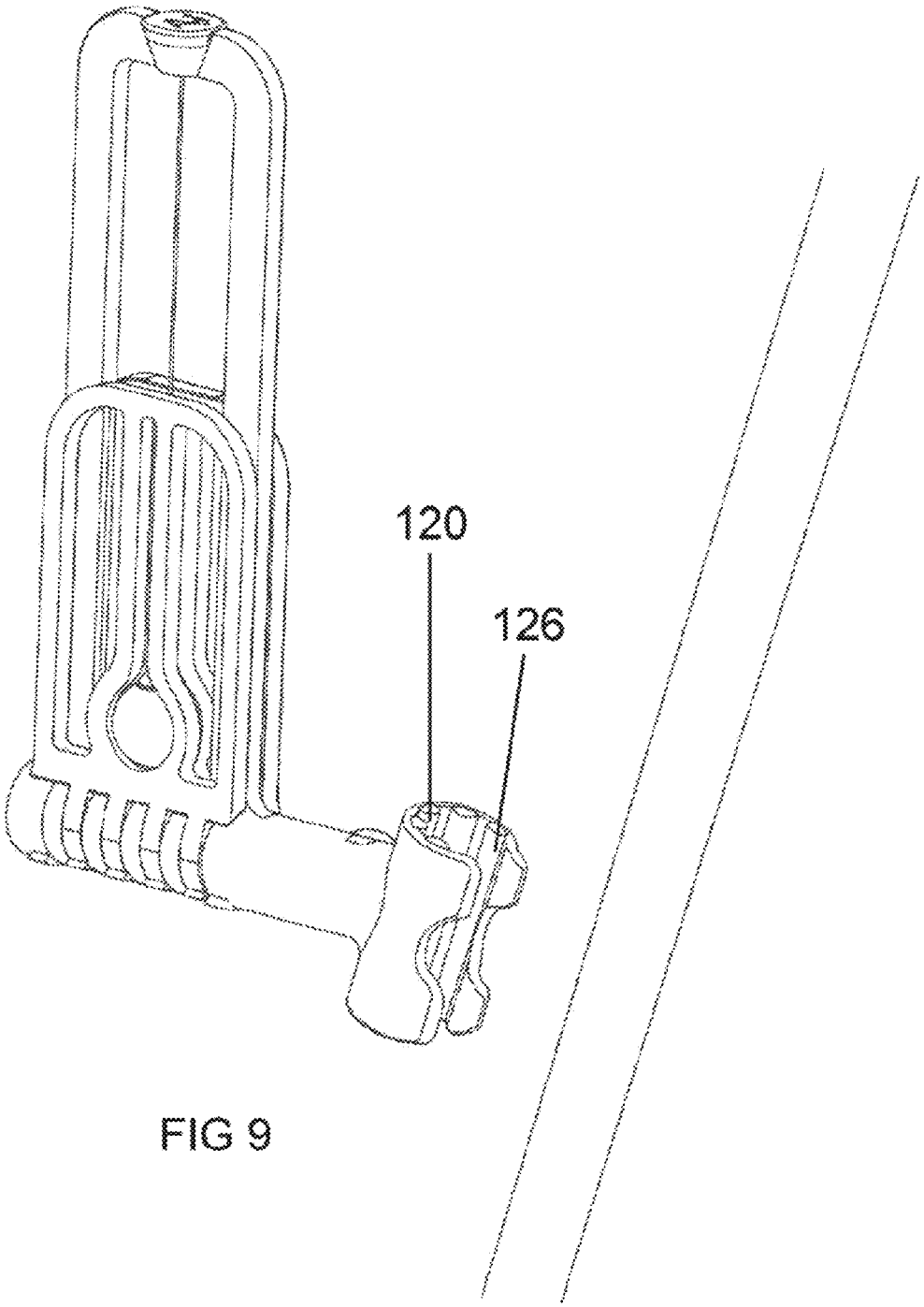
FIG. 9 is an isometric view of the embodiment shown in FIG. 6 in a position ready for mounting on a putter shaft.
Figure 10:
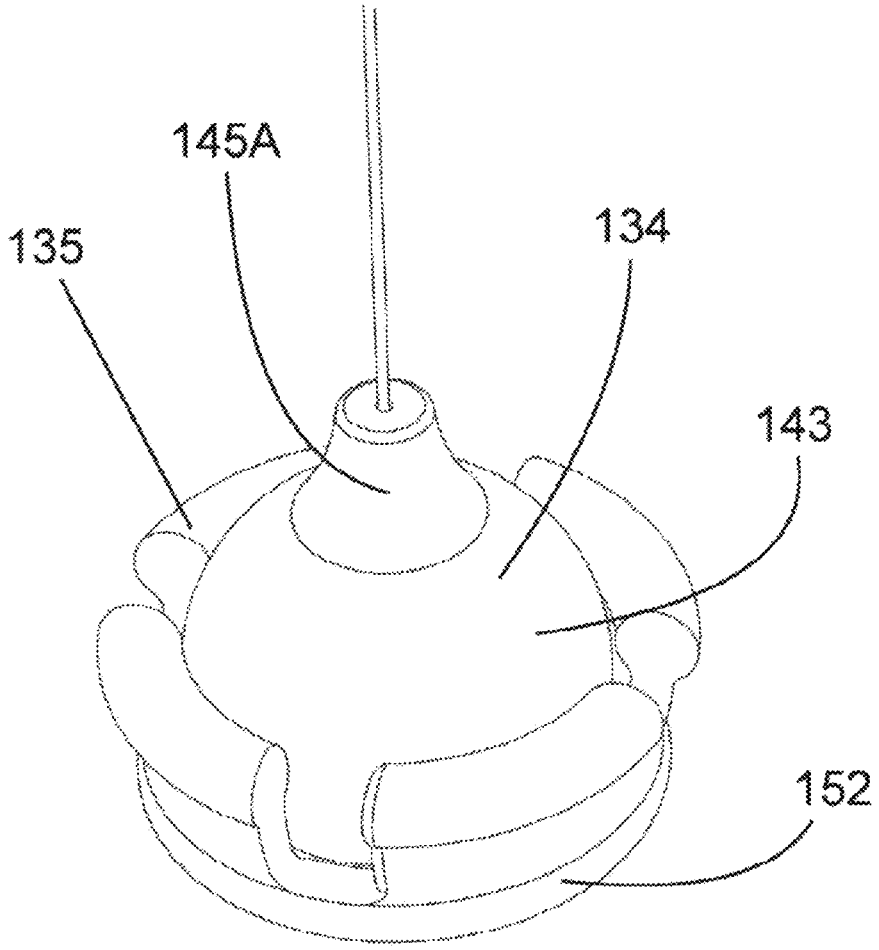
FIG. 10 is a detail view of a pendulum with another embodiment of a difficulty adjuster which is in the form of a crown shown in a deployed position on the pendulum, for reducing the distance between the pendulum and the frame.

In an embodiment shown in FIG. 5, there is shown a difficulty adjuster 50. In the FIGS. 1 to 5, it can be seen that the difficulty of a putt swing is increased by one or more extensible frame elements 52 which are configured to extend inwards toward the pendulum or the other frame elements, or there may be bosses or other formations which extend inward across the working gauge to increase the difficulty of the swing. In this embodiment of difficulty adjuster, the closer the frame elements to a centreline of the pendulum swing track, or to each other, then the more difficult the swing. The difficulty adjusters may be individually movable or linked so that movement of one moves the other.

The extensible element 52 is a plate 53 that extends upwards, or sidewards, to narrow or shorten the working gauge. One of the plates is a v-shaped plate 54, such that if it extends from the base, it will reduce the working gauge. One of the plates 53 is a rectangle 55, and may extend in from one side element towards the centreline.

In the embodiment shown in the FIGS. 6 to 11 it can be seen that the difficulty adjuster effectively enlarges the pendulum 34, 134. This forces a user to perform a more precise putt since the margin for error is smaller. There is a crown 135 which can adopt a stowed position on the frame (on the knot housing 145A) or a deployed position on the pendulum 134. The crown 135 effectively increases the diameter of the sphere to increase the difficulty of the putt training device. The crown 135 includes a ring 152 with a plurality of fingers mounted around the perimeter and extending axially therefrom which facilitates ease of mounting on the pendulum 134.

In an embodiment shown in FIG. 4 there is shown a swing attenuator 60 to reduce the difficulty of the swing. With the swing attenuator 60 in a deployed position (on the right of FIG. 4), the pendulum will not swing as far laterally as with the swing attenuator in a stowed position (on the left of FIG. 4).

The swing attenuator 60 is a sliding sleeve 62 which can slide downward on the frame 32 from the top of the working gauge (the stowed position) to attenuate the swing of the pendulum.

The peripheral frame assembly 36 may have vertically-extending side posts such as shown in FIGS. 1 to 3 and 6 to 11, or it may have contoured side posts as shown in FIGS. 4 and 5 where the side posts follow the contour of the pendulum.

In FIG. 5, it can be seen that there is a magnet in the side of the frame, which can draw the pendulum to the side of the frame if the putt is deficient. The frame elements of FIG. 5 are not vertical; they are horizontal. They are simply blocks or plates.

The indicating gauge 40 in FIGS. 1 to 3 includes a gauge surface 42 which indicates a preferred track 44 for the pendulum 34 to follow during a putting stroke. The gauge surface 42 is a line on one or more plates 46.

The one or more plates 46 are mounted to one or more frame elements. The plates 46 are transparent or translucent so that the user may see the putter through the plate 46. The one or more plates 46 are formed from plastic.

An indicating track 47 is a painted or printed line on the surface 42 of the one or more plates 46. The one or more plates 46 are pivotally mounted on the frame 32.

The one or more plates 46 are configured to adopt a stowed position in which the plate (and track) are disposed in a vertical position (FIG. 2), in which the track is not visible by the player during a stroke, and a deployed position (FIGS. 1 and 3) in which the indicating track 47 is visible by the player during a stroke.

The stowed position of the indicating plates 46 is such that they also keep the pendulum 34 in a stowed position, in which the pendulum is inhibited from swinging. The deployed position of the plates 46 allows the pendulum 34 to be free to swing.

So, a keeper 70 is integral with the plates 46, and is provided to keep the pendulum in the stowed position. The keeper 70 is in the form of a shield assembly 72 mounted on the frame, and the shield assembly 72 is the gauge plates 46. The gauge (keeper) plates 46 include one or more retaining flanges 74, so that they are effectively domed so as to retain the pendulum mass inside the borders of the plates, keeping the pendulum tidy.

The indicating gauge 140 in FIGS. 6 to 11 is a frame 146 with frame members to indicate a preferred track 144 for pendulum 134 to follow during a stroke. The indicating gauge 140 includes a through indicating aperture 147 within two parallel frame members to indicate the preferred track of the pendulum. The frame 146 is planar for ease of storage. The frame may be concave to mirror the arcuate movement of the pendulum.

The indicating plates or frames 146 swing between the deployed and stowed positions. The pivoting axis is directly under the pendulum swing point, which is effected by staggered pivoting bores which can be clearly seen in the exploded view of FIG. 8.

There is a keeper 170 in the FIGS. 6 to 11, which is on the indicating gauge 140, the keeper 170 being in the form of a retaining annulus 172 which at least partially encircles the pendulum 134 when the indicating gauge 140 is in the stowed position. The annulus 172 is in the form of an enlargement of the aperture 147 between the two parallel frame members. The two frame members diverge so as to encircle at least a portion of the pendulum 134 when in the stowed position.

There is a magnet 199 provided in the embodiment of FIGS. 6 to 11, to slow the pendulum 134. The magnet 199 provides a detent function in that when the pendulum is slow enough, it will be stopped and held in place with a light force to provide a stable starting point for the user when wanting to putt.

Figure 11:
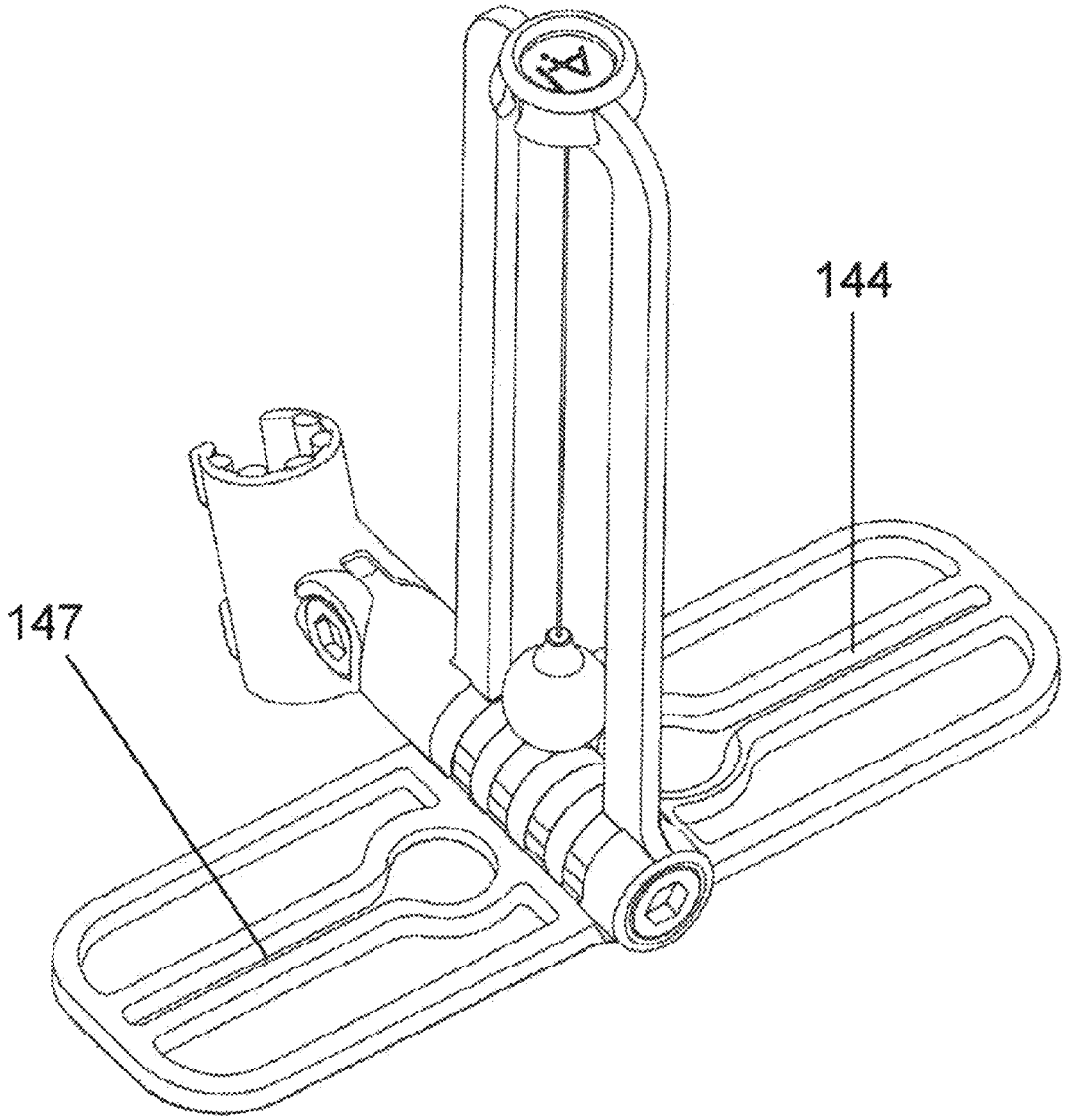
FIG. 11 is an isometric view of the training device of FIG. 6 but showing the crown in a stowed position on the frame.

Operation is fairly straightforward—mount the shaft mount 20 on the shaft 3, such that the grip ribs 126 get a good hold on the shaft 3. Then, the user aligns the working gauge frame elements vertically by rotating the frame about the pivot 27, 127. Then, the user deploys the keeping/indicating plates/frames 46 horizontally, by swinging them downward from the stowed position (FIG. 7) into the deployed position (FIG. 11). The user takes the putter into the hand, addresses the ball, and swings the putter 3. The pendulum swings through the working gauge, and along the indicator aperture 147 if the putter is swung well.

When the putt or putt training session is complete, the plates 146 are swung upwardly into the stowed position (FIG. 7) to capture the pendulum 134 in the retaining annulus 172. The device is removed from the shaft.

Clarifications

Modifications and improvements to the invention will be readily apparent to those skilled in the art. Such modifications and improvements are intended to be within the scope of this invention.

What is claimed is:

1. A putting training device including:

a shaft mount for mounting on a putter shaft;

a pendulum assembly mounted on the mount; the pendulum assembly including a swinging pendulum and at least one frame element to support the swinging pendulum, the at least one frame element providing a working gauge within which the swinging pendulum is configured to swing;

further including an indicating gauge operatively connected to the pendulum assembly for indicating a preferred track for the swinging pendulum;

wherein the indicating gauge includes one or more indicating gauge plates pivotally mounted on the at least one frame element so as to pivotally move between a stowed position and a deployed position.

2. The putting training device in accordance with claim 1 wherein the shaft mount is a clip.

3. The putting training device in accordance with claim 2 wherein the clip includes a grip liner covering internal clip walls to increase friction on the putter shaft.

4. The putting training device in accordance with claim 1 further comprising a grip and clip faces, and wherein the grip includes a plurality of grip ribs spaced around or along the clip faces.

5. The putting training device in accordance with claim 1 wherein the shaft mount includes a movable joint to orient the swinging pendulum in an upright position.

6. The putting training device in accordance with claim 1 wherein the pendulum is anchored at a base, such that a swaying motion is imparted during a putt.

7. The putting training device in accordance with claim 1 wherein the working gauge is defined by a peripheral frame assembly.

8. The putting training device in accordance with claim 1 wherein the working gauge includes two spaced-apart posts.

9. The putting training device in accordance with claim 1 wherein the swinging pendulum includes a mass disposed on a distal end of a line and attached to a top of the at least one frame element, to provide free swinging.

10. The putting training device in accordance with claim 1 wherein the pendulum is a rigid element.

11. The putting training device in accordance with claim 1 wherein there is provided a difficulty adjuster comprising a crown or cuff or ring for attachment to a working gauge frame element or to the pendulum.

12. The putting training device in accordance with claim 1 wherein a swing attenuator is provided which includes a magnet disposed in a base of the pendulum assembly, adjacent a centre point of the swing.

13. The putting training device in accordance with claim 1 wherein the indicating gauge includes one or more indicating gauge plates which include indicators which include an indicating track mounted on or in the plate to show a preferred track for the swinging pendulum.

14. The putting training device in accordance with claim 13 wherein the indicating track is an aperture or plurality of apertures through the indicating gauge plate, or a painted or printed line on a surface of one or more plates, to show the preferred track for the swinging pendulum.

15. The putting training device in accordance with claim 1 wherein the indicating gauge includes one or more indicating gauge plates pivotally mounted on the at least one frame element so as to pivotally move between a stowed position and a deployed position.

16. The putting training device in accordance with claim 1 further comprising indicating gauge plates wherein the indicating gauge plates include one or more retainers for the swinging pendulum.

17. A putting training device including:

a shaft mount for mounting on a putter shaft;

a pendulum assembly mounted on the mount; the pendulum assembly including a swinging pendulum and at least one frame element to support the swinging pendulum, the at least one frame element providing a working gauge within which the swinging pendulum is configured to swing, wherein said putting training device is configured to adopt a stowed position in which the pendulum is inhibited from swinging, in which a position of the indicating gauge is configured to adopt a position to clamp against the pendulum so that the pendulum is retained in an inoperative position, and a deployed position where the indicating gauge is distal the pendulum so that the pendulum is free to swing.

18. A putting training device including:

a shaft mount for mounting on a putter shaft;

a pendulum assembly mounted on the mount; the pendulum assembly including a swinging pendulum and at least one frame element to support the swinging pendulum, the at least one frame element providing a working gauge within which the swinging pendulum is configured to swing;

further including an indicating gauge operatively connected to the pendulum assembly for indicating a preferred track for the swinging pendulum, further comprising at least one indicating gauge plates and wherein the at least one indicating gauge plates includes an annulus for retaining a mass of the swinging pendulum between the indicating gauge plates when they are in the stowed position.

19. A putting training device including:

a shaft mount for mounting on a putter shaft;

a pendulum assembly mounted on the mount, the pendulum assembly including a swinging pendulum and at least one frame element to support the swinging pendulum, and an indicating gauge including at least one indicating gauge plates operatively connected to the pendulum assembly which include indicator tracks disposed thereon or therein for indicating a preferred track for the swinging pendulum, wherein the at least one indicating gauge plates are configured to adopt a stowed position to retain the swinging pendulum in an inoperative position, and an indicating or deployed position in which the indicator plates are distal the pendulum, to allow the swinging pendulum to swing, and the plates indicate the preferred track for the swinging pendulum.

* * * * *